US006968976B2

(12) United States Patent
Masuda

(10) Patent No.: US 6,968,976 B2
(45) Date of Patent: Nov. 29, 2005

(54) VALVE MECHANISM FOR TUBE-TYPE FLUID CONTAINER

(76) Inventor: Masatoshi Masuda, 2, 9-banchi, Takada-Cho, Saiin, Ukyo-ku, Kyoto-city, Kyoto 615-0031 (JP)

( * ) Notice: Subject to any disclaimer, the term of this patent is extended or adjusted under 35 U.S.C. 154(b) by 137 days.

(21) Appl. No.: 10/464,023

(22) Filed: Jun. 18, 2003

(65) Prior Publication Data

US 2004/0007601 A1 Jan. 15, 2004

(30) Foreign Application Priority Data

Jun. 26, 2002 (JP) ..... 2002-186828
Jul. 8, 2002 (JP) ..... 2002-198090

(51) Int. Cl.[7] ..... B65D 35/00
(52) U.S. Cl. ..... 222/92; 222/494
(58) Field of Search ..... 222/92, 95–107, 222/206, 212, 215, 491, 494, 511; 137/843, 137/845, 859, 860; 251/902

(56) References Cited

U.S. PATENT DOCUMENTS 1,709,948 A * 4/1929 Proctor ..... 222/494
1,880,103 A * 9/1932 Murdoch ..... 222/494
1,972,344 A * 9/1934 Jackson ..... 222/494
2,355,862 A * 8/1944 Harper ..... 137/512
2,556,571 A * 6/1951 Bobbs et al. ..... 222/92
4,712,583 A * 12/1987 Pelmulder et al. ..... 137/852
4,785,978 A * 11/1988 Kano et al. ..... 222/482
4,966,185 A * 10/1990 Schram ..... 137/223
5,121,840 A * 6/1992 Schram ..... 206/522
5,275,312 A * 1/1994 Labruzzo ..... 222/212
5,617,897 A * 4/1997 Myers ..... 137/859
6,089,272 A * 7/2000 Brand et al. ..... 137/859

FOREIGN PATENT DOCUMENTS

| | | |
|---|---|---|
| DE | 41 19 634 A1 | 12/1992 |
| DE | 101 09 064 A | 9/2002 |
| EP | 1 291 288 A2 | 3/2003 |
| GB | 2 260 535 A | 4/1993 |
| JP | 49-67781 | 7/1974 |
| JP | 09-226788 | 9/1997 |
| WO | WO 02/22458 A1 | 3/2002 |

* cited by examiner

*Primary Examiner*—Michael Mar
*Assistant Examiner*—Patrick Buechner
(74) *Attorney, Agent, or Firm*—Knobbe, Martens, Olson & Bear LLP

(57) ABSTRACT

A valve mechanism adapted for a mouth portion of a tube-type fluid container includes: a valve seat portion having an opening through which a fluid passes; a disc-shaped valve portion; and an annular fixing portion for affixing the valve portion to the valve seat portion. The valve portion includes: an annular supporting portion, a closing portion for closing the opening, and multiple connecting portions connecting the closing portion to the annular supporting portion to urge the closing portion toward the opening. The annular supporting portion, the closing portion, and the multiple connecting portions are integrally formed.

11 Claims, 10 Drawing Sheets

VALVE MECHANISM FOR TUBE-TYPE FLUID CONTAINER

BACKGROUND OF THE INVENTION

The present invention relates to a valve mechanism, particularly to a valve mechanism which can be used for a tube-type fluid container.

As this type of valve mechanism, for example, as described in Japanese Patent Laid-open No. 2001-179139, a valve mechanism having a spherical valve body and a spring for giving momentum to the valve body toward a valve seat has been used. Manufacturing costs of the valve mechanism using the spherical valve body and the spring, however, tend to be high.

Consequently, a valve mechanism having a resinous valve seat, and a resinous valve body which moves between a closed position in which the valve body contacts the valve seat and an open position in which the valve body separates from the valve seat is commonly used.

In the resinous valve mechanism, it is preferred that the valve mechanism has a simple configuration which can close a fluid flow reliably. Additionally, it is preferred that the configuration can alter a flow rate of the fluid passing through the valve mechanism discretionally according to a pressure applied to the fluid. As matters stand, however, a valve mechanism satisfying these requirements is not reported.

SUMMARY OF THE INVENTION

The present invention has been achieved to solve the above-mentioned problems. It aims to provide a valve mechanism which can close a fluid reliably while its configuration is simple and which can alter a flow rate of the fluid passing through the valve mechanism discretionally according to a pressure applied to the fluid.

The present invention includes, but is not limited to, the embodiments explained below. Solely for the sake of understanding some embodiments of the present invention easily, reference numerals used in the figures explained later are referred to. However, the present invention is not limited to the structures defined by these reference numerals, and any suitable combination of elements indicated by these reference numerals can be accomplished.

In an embodiment, a valve mechanism adapted for a mouth portion (a head portion, e.g., 42) of a tube-type fluid container (a container main unit, e.g., 40), comprising: (a) a valve seat portion (e.g., 30, 130) having an opening (e.g., 43, 133) through which a fluid passes; (b) a disc-shaped valve portion (e.g., 20) comprising: (i) an annular supporting portion (e.g., 21), (ii) a closing portion (e.g., 22) for closing the opening, said closing portion having an outer diameter (e.g., A) smaller than an inner diameter (e.g., B) of the annular supporting portion and larger than an inner diameter (e.g., C) of the opening, and having a convex shape (e.g., 22') toward the opening; and (iii) multiple connecting portions (coupling portions, e.g., 23) connecting the closing portion to the annular supporting portion to urge the closing portion toward the opening, wherein the annular supporting portion, the closing portion, and the multiple connecting portions are integrally formed; and (c) an annular fixing portion (e.g., 101, 16) for affixing the valve portion to the valve seat portion by interposing the supporting portion between the fixing portion and the valve seat portion.

The present invention includes, but is not limited to, the following configurations in other embodiments: The valve seat portion may have a convex annular portion (e.g., 44, 134) around the opening toward the closing portion. The annular fixing portion may be an integrated part of a nozzle cap (e.g., 10, 110, 19) for discharging a fluid. The valve seat portion (e.g., 30) may be integrally formed in the mouth portion (e.g., 42) of the container. The valve seat portion (e.g., 130) may be fitted in the mouth portion (e.g., 142) of the container. The valve seat portion (e.g., 30, 130) may have an annular step (e.g., 35, 135) at its periphery which is in contact with the annular supporting portion (e.g., 21). The connecting portions may have at least three (e.g., three to six) connectors (e.g., 23). The connecting portions (e.g., 23) may connect the closing portion to the annular supporting portion (e.g., 21) in radial directions (or outward spiral directions). Further, the valve seat portion may be replaceable and selected based on the consistence of the fluid.

In another aspect of the present invention, a tube-type fluid container (e.g., 40) comprises a container body (e.g., 41) for storing a fluid having a mouth portion (e.g., 42, 142), and the valve mechanism described above attached to the mouth portion.

According to an embodiment or embodiments of the present invention, a fluid can be closed reliably although a configuration is simple; it becomes possible to change a flow rate of the fluid passing through the opening discretionally according to a pressure applied thereto. Particularly, when using a fixing portion integrated with a nozzle cap and/or when using a valve seat portion integrated with a mouth portion, it becomes possible to reduce the number of parts.

In the above, the fluid can be discharged from an outlet of the mouth portion of the container through the valve mechanism by pressing the container, wherein the connectors and the container are deformed. When releasing the pressure, both the deformed connectors and the deformed container begin restoring the shapes. The restoring force of the container causes the inner pressure to lower, thereby generating reverse flow which facilitates restoration of the connectors to close the opening of the valve seat portion, thereby effectively preventing air from coming into the container through the outlet of the mouth portion. Thus, even if the restoring force of the connectors themselves is not sufficient to close the opening of the valve seat portion, the outlet of the mouth portion can effectively be closed in combination with the restoring force of the container. Thus, even if the fluid is very viscous, the valve mechanism in combination with the container can discharge the fluid and then seal the container.

Further, in an embodiment of the present invention, the valve portion has a closing portion having a convex shape toward the opening, and due to the convex shape, the connectors can slightly be deformed even when the opening is closed, and restoring force is exerted on the closing portion toward the opening, thereby improving sealability. This feature may be improved when providing a convex portion in the valve seat portion (e.g., around the opening and/or around the periphery).

For purposes of summarizing the invention and the advantages achieved over the related art, certain objects and advantages of the invention have been described above. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

Further aspects, features and advantages of this invention will become apparent from the detailed description of the preferred embodiments which follow.

BRIEF DESCRIPTION OF THE DRAWINGS

These and other features of this invention will now be described with reference to the drawings of preferred embodiments which are intended to illustrate and not to limit the invention.

Explanation of symbols used is as follows: 10: Fixing material; 11: Opening portion; 12: Female screw portion; 19: Fixing material; 20: Valve material; 21: Supporting portion; 22: Closing portion; 23: Connecting portion; 30, 130: Valve seat material; 131: Flange portion; 132: Concave portion; 133: Opening portion; 134: Convex portion; 40: Container main unit; 41: Fluid storing portion; 42, 142: Head portion; 43: Opening portion; 44: Convex portion; 45: Male screw portion

DETAILED DESCRIPTION OF THE PREFERRED EMBODIMENT

Preferred embodiments of the present invention will be described with referent to the drawings. The present invention is not limited to the embodiments.

An embodiment of the present invention may be characterized in that comprising a valve seat material in which an opening portion for passing a fluid therethrough is formed; a valve material comprising a resin having elasticity, which comprises a ring-shaped supporting portion, a closing portion having an outer diameter smaller than an inner diameter of the supporting portion and larger than an inner diameter of the opening portion, is disposed nearly at the center of the supporting portion and is able to close the opening portion in the valve seat portion, and multiple connecting portions which couple the supporting portion and the closing portion; a fixing material which fixes the valve material by holding the valve material tightly between the valve seat material.

Another embodiment of the present invention may be characterized in that the closing portion in the valve material has a convex shape facing toward the opening portion in the valve seat material.

Still another embodiment of the present invention may be characterized in that on the outer circumferential portion of the opening portion in the valve seat material, a convex portion facing toward the closing portion in the valve material is formed.

Yet another embodiment of the present invention may be characterized in that the fixing material has a nozzle shape for discharging a fluid.

Figure 1:
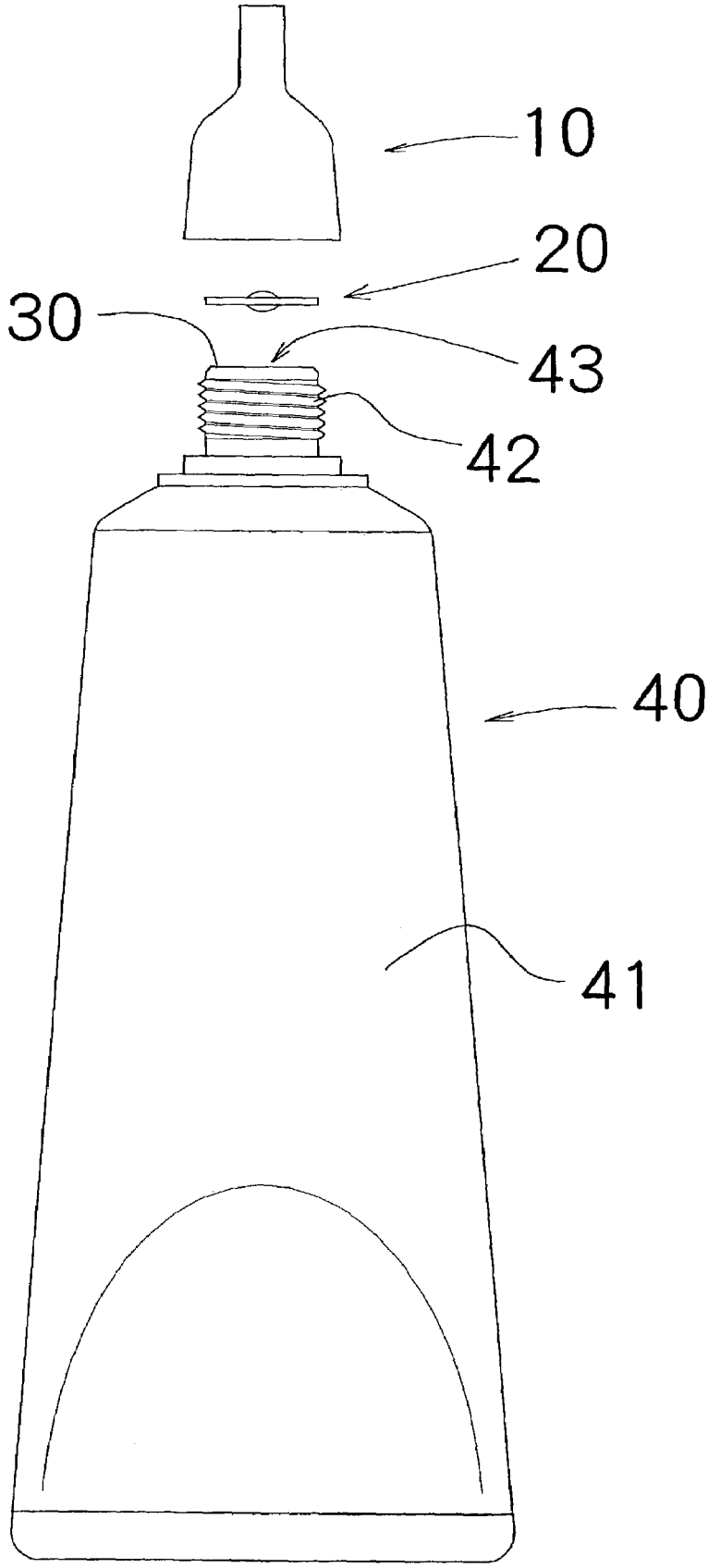
FIG. 1 is an exploded explanatory diagram showing an embodiment of a tube-type container to which the valve mechanism according to Embodiment 1 of the present invention applies.
Figure 2:
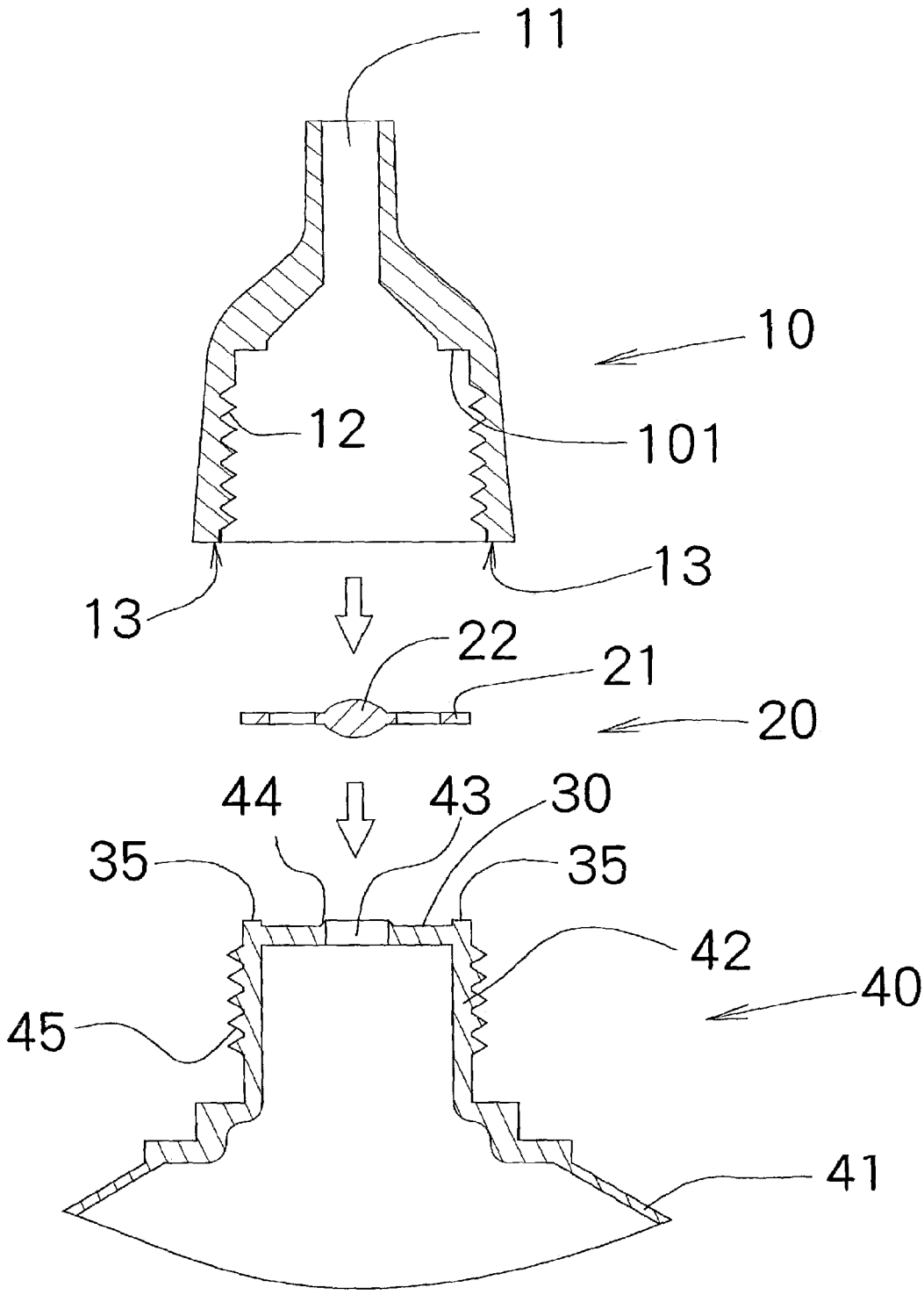
FIG. 2 is an exploded sectional view showing the relevant part of the tube-type container to which the valve mechanism according to Embodiment 1 of the present invention applies.
Figure 3A:
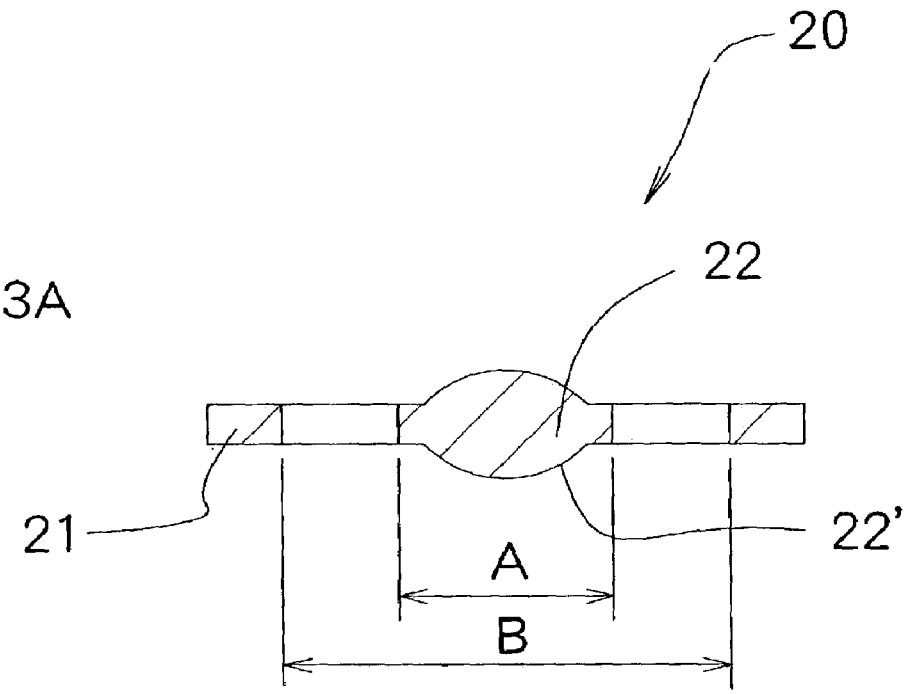
FIG. 3A and FIG. 3B are a cross sectional view and a top view of the valve material 20, respectively.
Figure 3B:
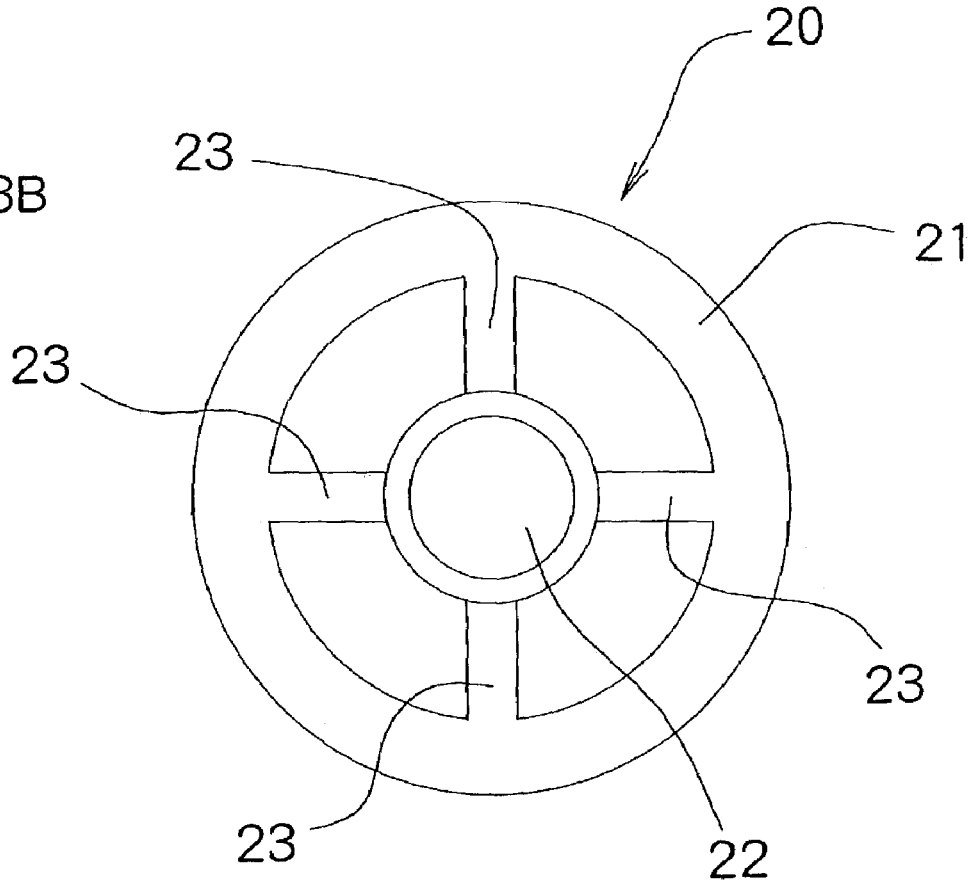
Figure 4:
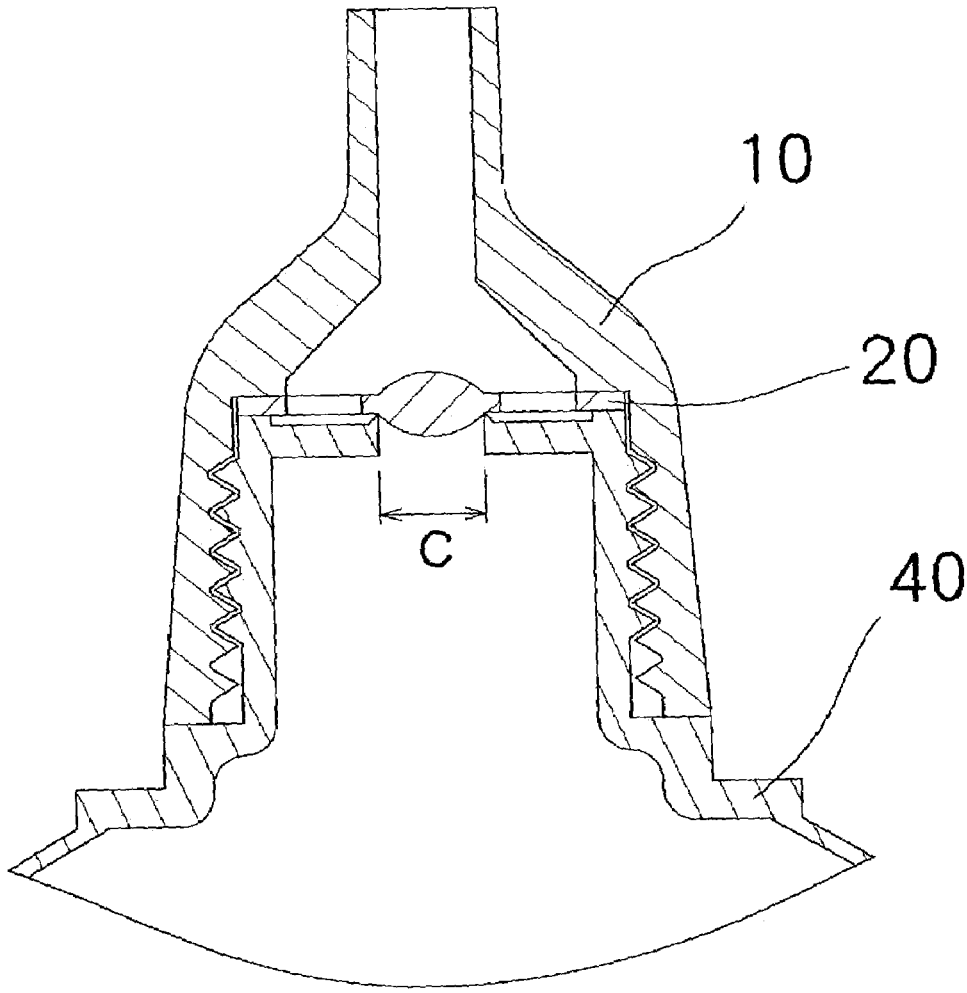
FIG. 4 and FIG. 5 are explanatory diagrams showing fluid discharging motions by the tube-type container to which the valve mechanism according to Embodiment 1 of the present invention applies.
Figure 5:
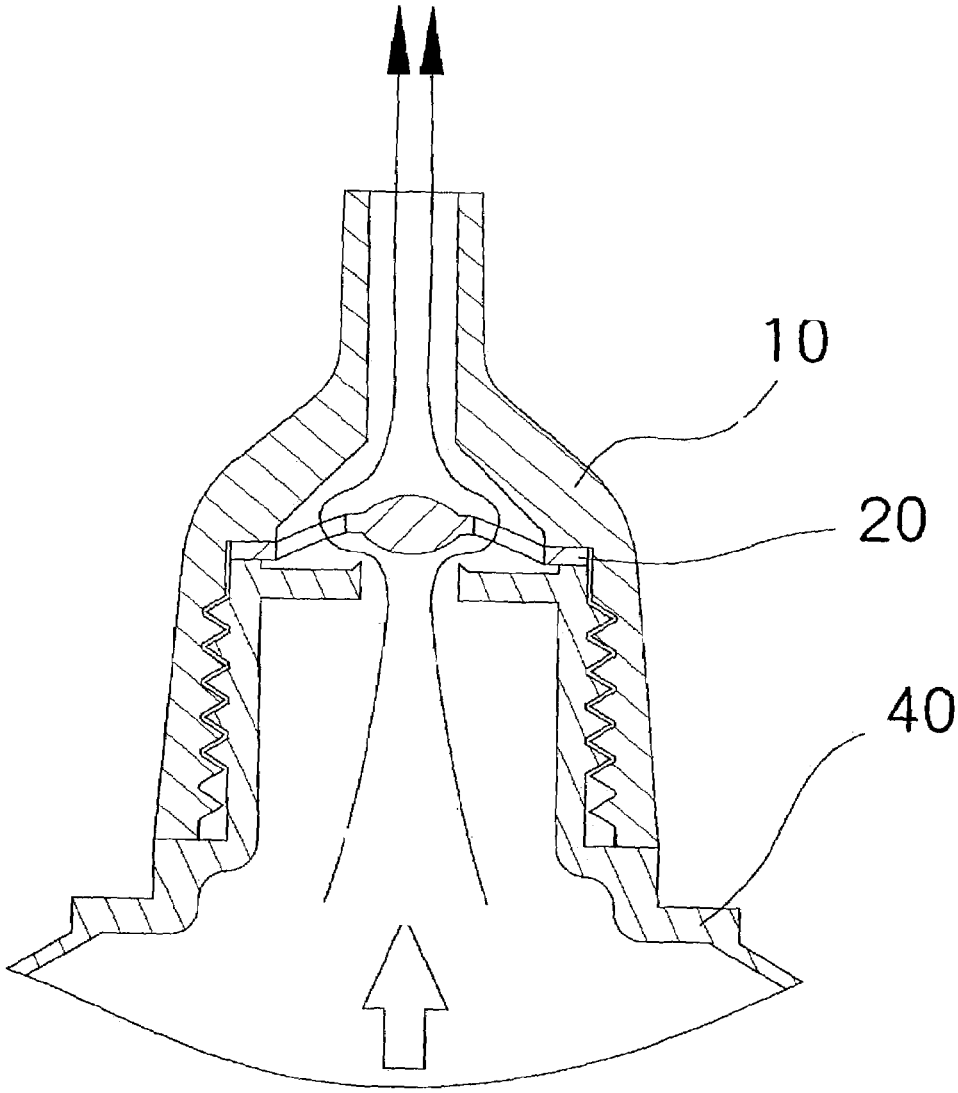

Preferred embodiments of the present invention are described with referent to the drawings. However, the present invention is not limited to these drawings. FIG. 1 is an exploded explanatory diagram showing a tube-type container to which the valve mechanism according to Embodiment 1 of the present invention applies. FIG. 2 is an exploded sectional view showing the relevant part of the valve mechanism. FIG. 3A and FIG. 3B are enlarged explanatory diagrams showing the valve material 20. FIG. 3A shows a longitudinal section of the valve material 20; FIG. 3B shows a plan view of the valve material 20. FIG. 4 and FIG. 5 are explanatory diagrams showing fluid discharging motions by the tube-type container to which the valve mechanism according to Embodiment 1 of the present invention applies.

This tube-type container is used as a container for beauty products for storing gels such as hair gels and cleansing gels or creams such as nourishing creams and cold creams used in the cosmetic field. Additionally, this tube-type container also can be used as a container for medicines, solvents or foods, etc.

In this specification, regular liquids, high-viscosity liquids, semifluids, gels that sol solidifies to a jelly, and creams are all referred to as fluids. Application of the present invention, however, is not limited to a valve mechanism used for the above-mentioned fluids; the present invention can apply to a valve mechanism used for the entire fluids including gases.

This tube-type container comprises a container main unit 40, a valve material 20 and a fixing material 10.

The container main unit 40 comprises a fluid storing portion 41 for storing a fluid inside it and a head portion 42 on whose outer circumferential portion, a male screw portion 45 is formed and on whose upper end portion, an opening portion 43 for letting the fluid pass through is formed. On the outer circumferential portion of the opening portion 43 in the head portion 42, a ring-shaped convex portion 44 facing toward the valve material 20 is formed. Additionally, this container main unit 40 comprises a synthetic resin alone or a lamination of a synthetic resin and aluminum, and has an elasticity recovering force which tries to recover its original shape when a pressure applied to it is removed. The head portion 42 in the container main unit 40 functions as the valve seat material according to the present invention.

The above-mentioned valve material 20, as shown in FIG. 3A and FIG. 3B, comprises a ring-shaped supporting portion 21, a closing portion 22 which is arranged at nearly the center of the supporting portion 21, and four connecting portions 23 which couple the supporting portion 21 and the closing portion 22. An outer diameter of the closing portion 22 in the valve material 20 is smaller than an inner diameter of the supporting portion 21 and larger than an inner diameter of the opening portion 43 formed in a head portion 42 of the container main unit 40. Additionally, this closing portion 22 has a convex shape facing toward the opening portion 43 in the head portion 42. Consequently, the closing portion 22 is able to close the opening portion 43 by contacting the convex portion 44 formed on the outer circumferential portion of the opening portion 43.

As shown in FIG. 3A and FIG. 3B, the closing portion 22 in the valve material 20 has a convex shape in both directions: In the direction of the opening portion 43 in the head portion 42; in the direction opposite to the opening portion 43 in the head portion 42. In other words, the closing portion 22 has a plane-symmetrical shape, which facilitates assembling work when a valve mechanism using this valve material 20 is assembled.

The valve material 20 comprises a resin having elasticity. As a resin having this elasticity, a resin such as polypropylene, synthetic rubber such as silicon rubber or a mixture of these materials can be used.

The above-mentioned fixing material 10 is used for fixing the valve material 20 by holding the valve material 20 tightly between its lower end portion 13 and the head portion 42 of the container main unit 40. On the inner circumferential portion of the fixing portion 10, as shown in FIG. 2, a female screw portion 12 which screws together with the male screw portion 45 formed on the outer circumferential portion of the above-mentioned head portion is formed. Additionally, the fixing portion 10 has a nozzle shape having an opening portion 11 for discharging a fluid.

In a tube-type container having the above-mentioned configuration, in a normal position, the convex closing portion 22 in the valve material 20 and the ring-shaped convex portion 44 formed in the head portion 42 in the container main unit 40 are in contact with each other as shown in FIG. 4, and the opening portion 43 is closed.

In this position, when a pressure is applied to the fluid inside the fluid storing portion 41 by pressing the fluid storing portion 41 in the container main unit 40, the opening portion 43 is opened as the convex closing portion 22 in the valve material 20 and the ring-shaped convex portion 44 formed in the head portion 42 in the container main unit 40 separate from each other by the elasticity of the valve material 20 as shown in FIG. 5; the fluid inside the fluid storing portion 41 is discharged outward via the opening portion 11 in the fixing material 10.

In this position, a distance between the convex closing portion 22 in the valve material 20 and a ring-shaped convex portion 44 formed in the head portion 42 in the container main unit 40 is proportional to a pressure applied to the fluid inside the fluid storing portion 41. Consequently, by changing a pressure applied to the fluid inside the fluid storing portion 41, changing a flow rate of the fluid passing through the opening portion 43 discretionally becomes possible. When a regular liquid is used as a fluid, therefore, discharging the liquid drop by drop by applying a small pressure to the liquid inside the fluid storing portion 41 becomes possible as well.

When the pressure applied to the fluid storing portion 41 is removed after a necessary amount of the fluid is discharged, the fluid inside the fluid storing portion 41 is depressurized by the elasticity recovering force of the container main unit 40; the air tries to flow back toward the fluid storing portion 41 from the opening portion 11. In this tube-type container, however, as shown in FIG. 4, the opening portion 43 in the container main unit 40 is closed by the elasticity of the valve material 20, a fluid flow path is closed. Consequently, the reverse flow of the air can be prevented effectively.

In the tube-type container to which the valve mechanism according to the above-mentioned Embodiment 1 applies, because the fixing portion 10 having a nozzle-shape, which can be used as both fixing portion and a nozzle, is adopted, the number of parts can be reduced.

Figure 6:
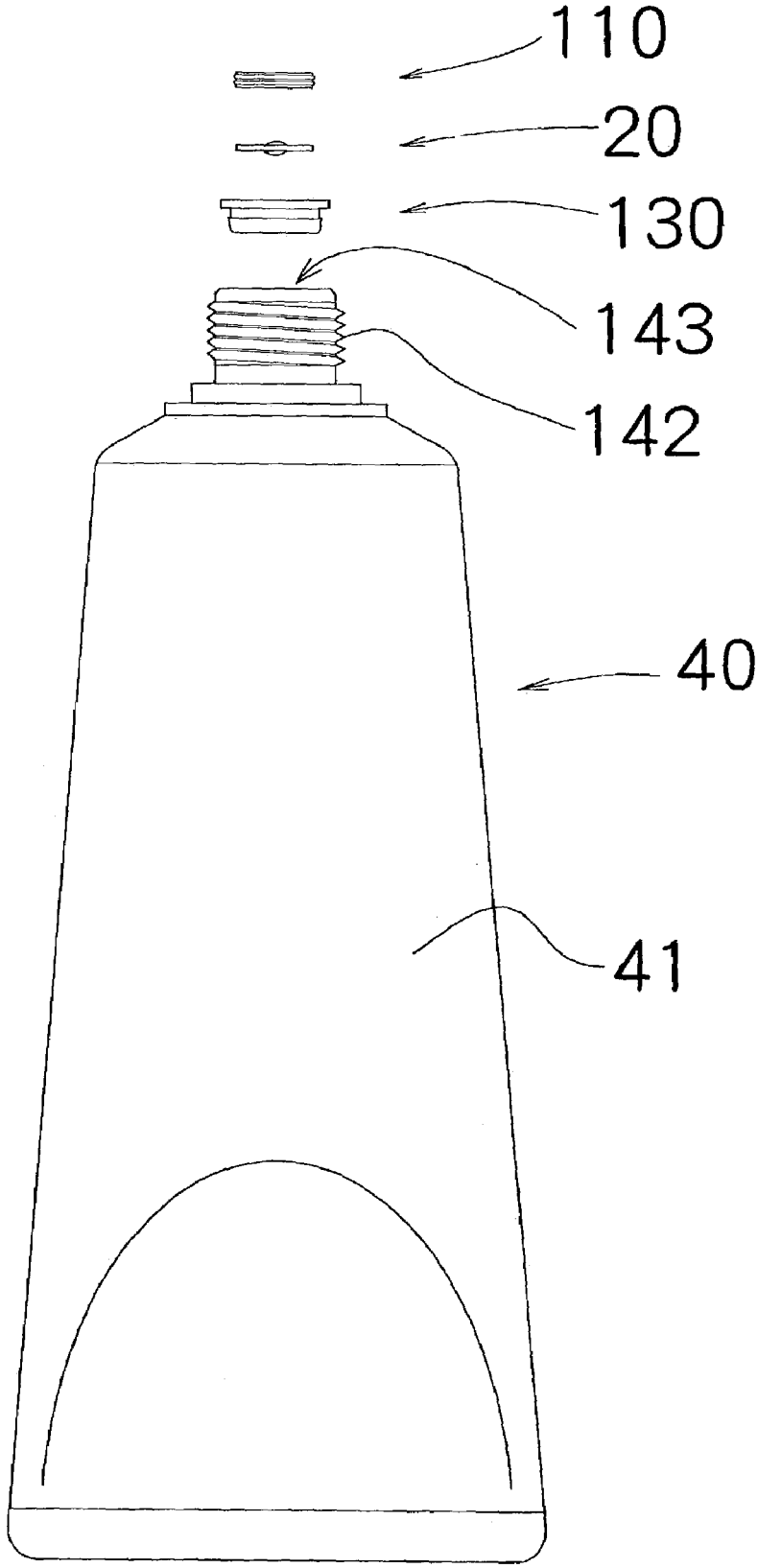
FIG. 6 is an exploded explanatory diagram showing a tube-type container to which the valve mechanism according to Embodiment 2 of the present invention applies.
Figure 7:
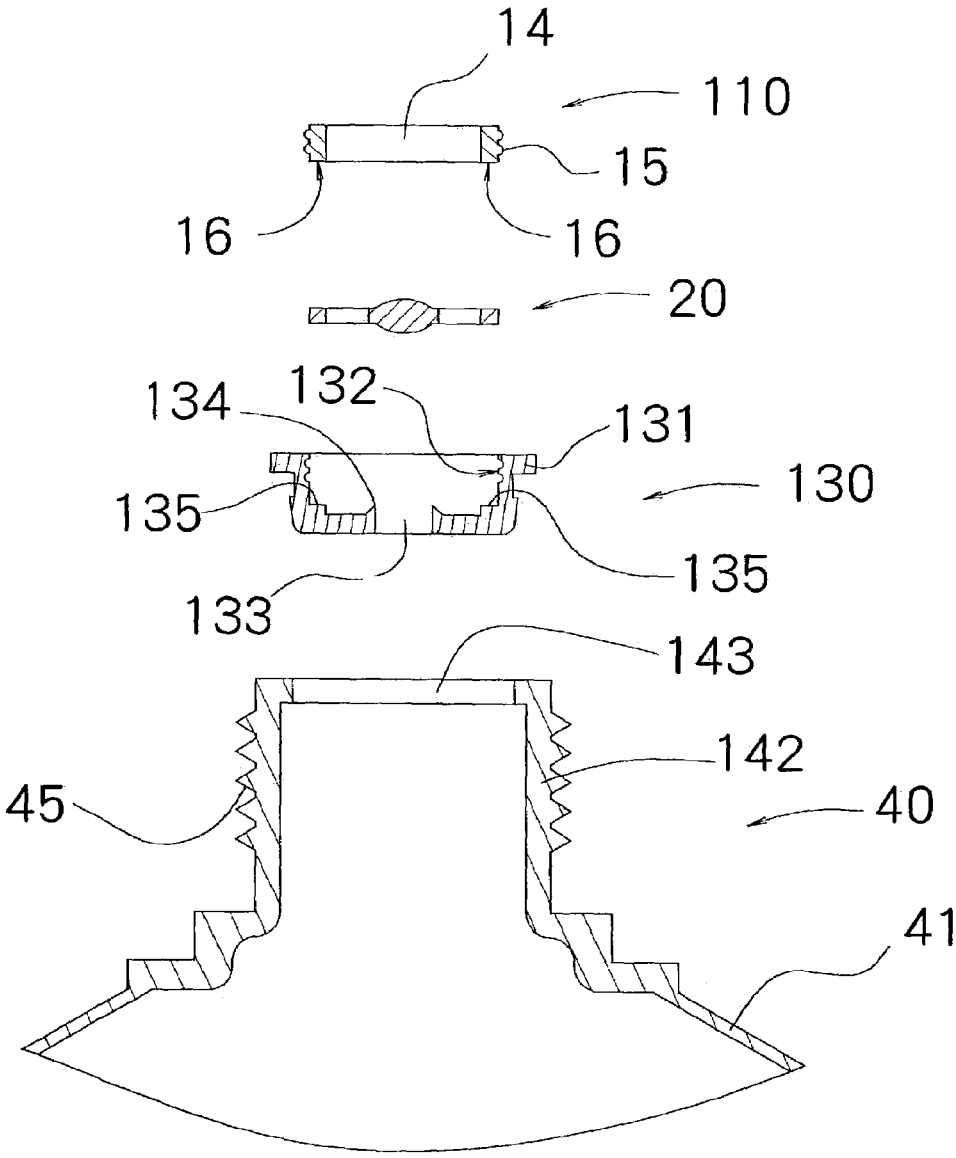
FIG. 7 is an exploded cross sectional view showing the relevant part of the tube-type container to which the valve mechanism according to Embodiment 2 of the present invention applies.
Figure 8:
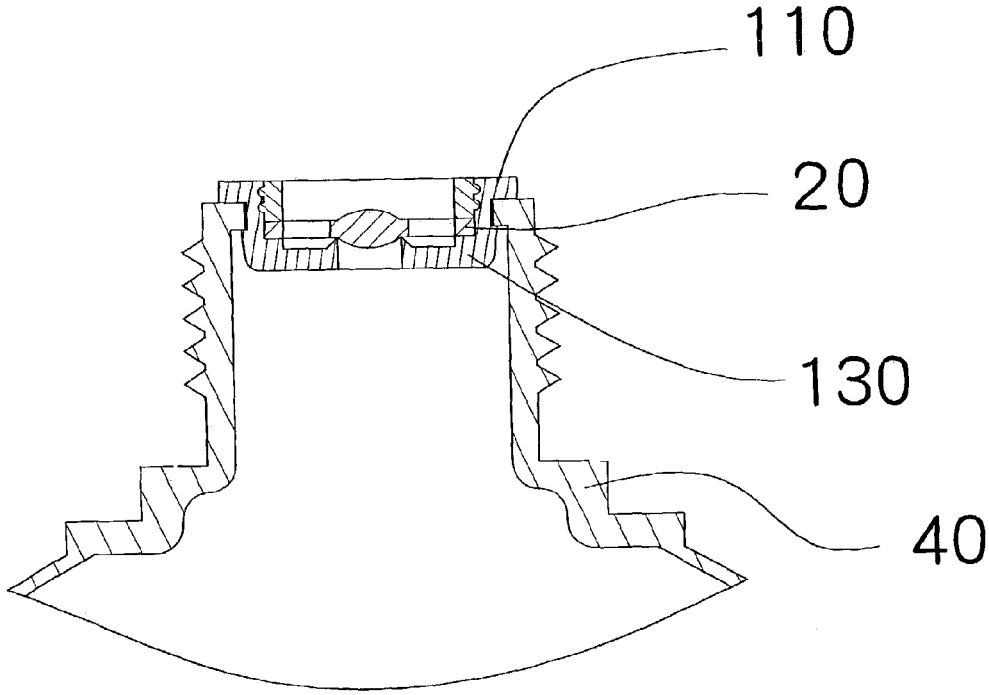
FIG. 8 and FIG. 9 are explanatory diagrams showing fluid discharging motions by the tube-type container to which the valve mechanism according to Embodiment 2 of the present invention applies.
Figure 9:
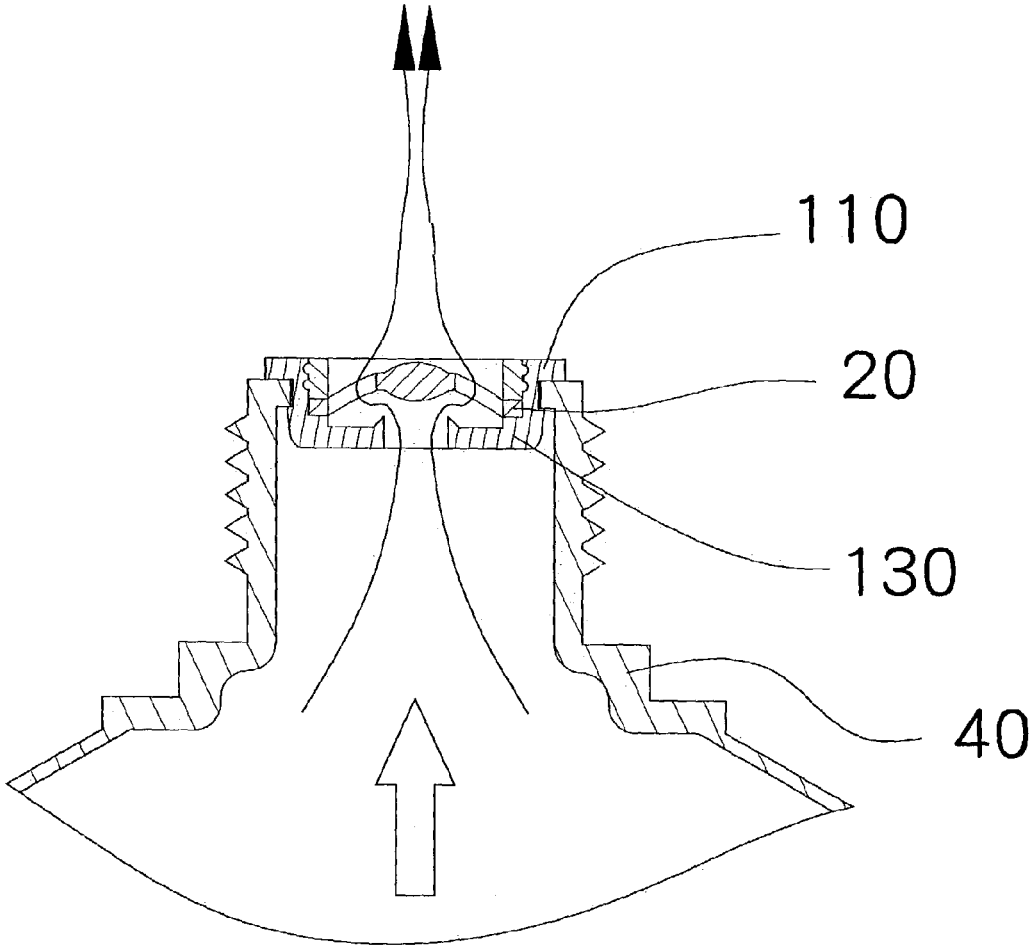
Figure 10:
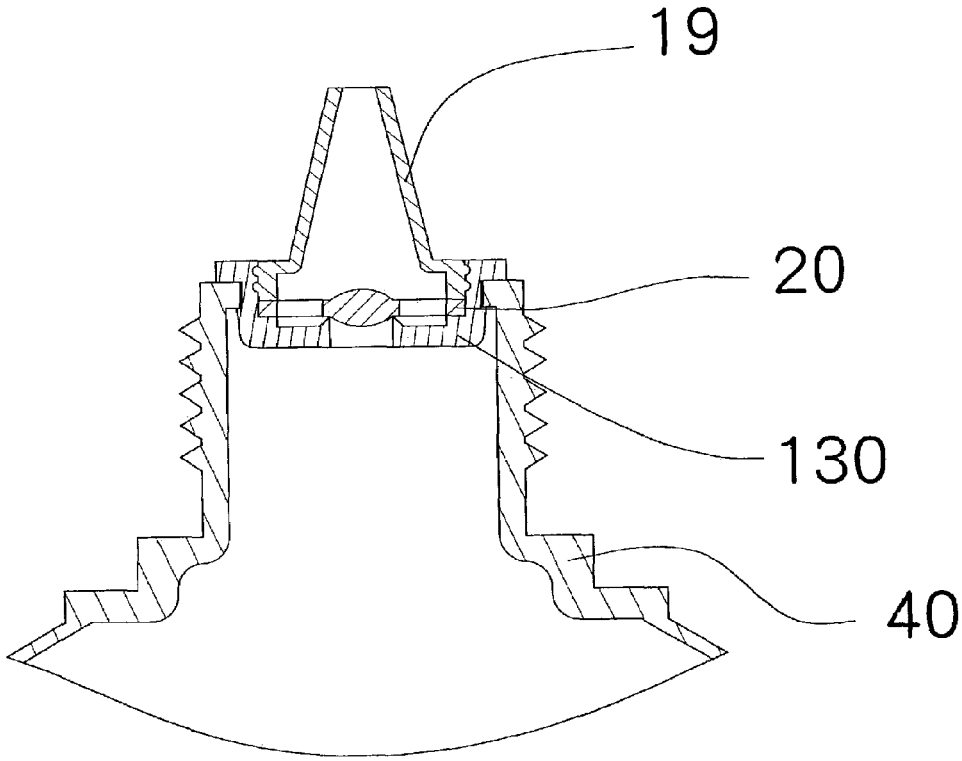
FIG. 10 is an explanatory diagram showing a modified version of the valve mechanism according to Embodiment 2 of the present invention.

An alternative embodiment of the present invention is described below. FIG. 6 is an exploded explanatory diagram showing the tube-type container to which the valve mechanism according to Embodiment 2 of the present invention applies. FIG. 7 is an exploded sectional view showing its relevant part. FIG. 8 and FIG. 9 are explanatory diagrams showing the fluid discharging motions by the tube-type container to which the valve mechanism according to Embodiment 2 of the present invention applies.

In the same manner as the tube-type container according to Embodiment 1, this tube-type container is used as a container for beauty products for storing gels such as hair gels and cleansing gels or creams such as nourishing creams and cold creams used in the cosmetic field. Additionally, this tube-type container also can be used as a container for medicines, solvents or foods, etc.

This tube-type container comprises a container main unit 40, a valve seat material 130, a valve material 20 and a fixing material 110.

In the same manner as in Embodiment 1, the above-mentioned container main unit 40 comprises a fluid storing portion 41 for storing a fluid inside it, and a head portion 142 on the outer circumferential portion of which a male screw portion 45 is formed and in the upper end of which an opening portion 143 for letting a fluid flow is formed. In the container main unit 40, however, an inner diameter of the opening portion 143 in the head portion 142 is larger than that of the opening portion of Embodiment 1; a convex portion 44 as formed in Embodiment 1 is not formed on the outer circumferential portion of the opening portion 143. Additionally, this container main unit 40 comprises a synthetic resin alone or a lamination of a synthetic resin and aluminum and has an elasticity recovering force which tries to recover its original shape when a pressure applied to it is removed.

The above-mentioned valve seat material 130 has a shape which can be fixed inside the opening portion 143 formed in the head portion 142 by contacting the flange portion 131 with the head portion 142 of the container main unit 40. At the bottom of this valve seat material, an opening portion 133 for letting the fluid through is formed; on the outer circumferential portion of this opening portion 133, a ring-shaped convex portion 134 facing toward the valve material 20 is formed. Additionally, on the inner circumferential surface of this valve seat material 130, a ring-shaped concave portion 132 is formed.

In the same manner as in Embodiment 1, the above-mentioned valve material 20 has a configuration shown in FIG. 3A and FIG. 3B. An outer diameter of the closing portion 22 in the valve material 20 is smaller than an inner diameter of a supporting portion 21 and larger than an inner diameter of the opening portion 133 formed in valve seat material 130. Additionally, this closing portion 22 has a concave shape facing toward the opening portion 133 in the valve seat material 130. Consequently, the closing portion 22 is able to close the opening portion 133 by contacting the convex portion 134 formed on the outer circumferential portion of the opening portion 133.

The above-mentioned fixing material 110 is used for fixing the valve material 20 by holding the valve material 20 tightly between its lower end portion 16 and the above-mentioned valve seat material 130. On the outer circumferential portion of this fixing material 110, a convex portion 15 which can engage with a concave portion 132 formed on the inner circumferential portion of the above-mentioned valve seat material 130 is formed. Consequently, this fixing material 110 is fixed inside the valve seat material 130 in a position in which the valve material 20 is held between the lower end portion 16 of the fixing material and the valve seat material 130.

In the tube-type container having the above-mentioned configuration, in a normal position, as shown in FIG. 8, the convex closing portion 22 in the valve material 20 and a ring-shaped convex portion formed in valve seat material 130 are in contact and the opening portion 133 is closed.

In this position, when a pressure is applied to the fluid inside the fluid storing portion 41 by pressing the fluid storing portion 41 in the container main unit 40, the opening portion 133 is opened as the convex closing portion 22 in the valve material 20 and the ring-shaped convex portion 134 formed in the valve seat material 130 separate from each other by the elasticity of the valve material 20 as shown in FIG. 9; the fluid inside the fluid storing portion 41 is discharged outward via the opening portion 14 in the fixing material 110.

In this position, a distance between the convex closing portion 22 in the valve material 20 and a ring-shaped convex portion 134 formed in the valve seat material 130 is proportional to a pressure applied to the fluid inside the fluid storing portion 41. Consequently, by changing a pressure applied to the fluid inside the fluid storing portion 41, changing a flow rate of the fluid passing through the opening portion 133 discretionally becomes possible. When a regular liquid is used as a fluid, therefore, discharging the liquid drop by drop by applying a small pressure to the liquid inside the fluid storing portion 41 becomes possible as well.

When the pressure applied to the fluid storing portion 41 is removed after a necessary amount of the fluid is discharged, the fluid inside the fluid storing portion 41 is depressurized by the elasticity recovering force of the container main unit 40; the air tries to flow back toward the fluid storing portion 41 from the opening portion 14. In this tube-type container, however, as shown in FIG. 8, the opening portion 133 in the valve seat material 130 is closed by the elasticity of the valve material 20, a fluid flow path is closed. Consequently, the reverse flow of the air can be prevented effectively.

Additionally, in the tube-type container to which the valve mechanism according to the above-mentioned Embodiment 2 applies, because the valve mechanism can be installed inside the head portion 142 in a commercially-available container main unit 40, installing an opening/closing valve feature in the opening portion of the commercially-available container main unit 40 becomes possible.

Additionally, in the above-mentioned Embodiment 2, the fixing material 110 which is nearly planate is used. A fixing material 19 having a nozzle shape similar to the one used in Embodiment 1, however, can be used as well to reduce the number of parts by using it as both a fixing material and a nozzle.

In the above-mentioned Embodiments 1 and 2, the closing portion 22 in the valve material 20 has a convex shape as well as a ring-shaped convex portion 44 facing toward the valve body 20 is formed on the outer circumferential portion of the opening portion 143 in the head portion 142 of the container main unit 40, or a ring-shaped convex portion 134 facing toward the valve material 20 is formed on the outer circumferential portion of the opening portion 133 in the valve material 130. If a convex shape is adopted for the closing portion 22 of the valve material 20, however, the above-mentioned ring-shaped convex portions 134 and 44 can be omitted. Additionally, when the ring-shaped convex portions 134 and 44 are adopted, it is possible to construct the closing portion 22 in the valve material 20 to be planate similarly to the supporting portion 21.

In the above-mentioned Embodiments 1 and 2, only the modes in which the valve mechanism according to the present invention is applied to the tube-type fluid storing container are described. The valve mechanism according to the present invention, however, also can be applied to fluid discharge pumps used for fluid storing containers, etc.

Furthermore, in respective embodiments mentioned above, although the present invention is applied to the valve mechanisms used for fluids, the present invention can be applied to valve mechanisms used for gases. In these cases, by using a material having high rigidity for the connecting portion 23, stronger momentum should be given to the closing portion 22 in the direction of convex portion 134 or 44.

In the present invention, any suitable plastic material can be used including rubbers such as silicon rubbers or soft resins such as soft polyethylene. For support portions (such as the valve seat portion) to which other portions (such as the valve portion) are fitted by press- fitting, hard resins such as hard polyethylene can preferably be used. The structures can be formed by any suitable methods including injection molding. The resin material can be selected based on the type of fluid stored in the container. If a high viscose fluid such as a gel is stored in the container, a hard resin may be used for the valve mechanism. If a low viscose fluid such as a thin liquid or a formed liquid is stored in the container, a more resilient resin may be used for the valve mechanism.

It will be understood by those of skill in the art that numerous and various modifications can be made without departing from the spirit of the present invention. Therefore, it should be clearly understood that the forms of the present invention are illustrative only and are not intended to limit the scope of the present invention.

What is claimed is:

1. A valve mechanism adapted for a mouth portion of a tube-type fluid container, comprising:

a valve seat portion having a single opening through which a fluid passes, said valve seat portion having (I) an annular convex portion along the opening and (II) an annular step at its periphery, wherein a tip of the annular convex portion and a top surface of the annular step are substantially of equal height;

a disc-shaped valve portion comprising: (i) an annular supporting portion which is in contact with the annular step, (ii) a closing portion for closing the opening at the tip of the annular convex portion, said closing portion having an outer diameter smaller than an inner diameter of the annular supporting portion and larger than an inner diameter of the opening, and having a convex shape toward the opening; and (iii) multiple connecting portions connecting the closing portion to the annular supporting portion to urge the closing portion against the tip of the annular convex portion along the opening, wherein the annular supporting portion, the closing portion, and the multiple connecting portions are integrally formed; and an annular fixing portion for affixing the valve portion to the valve seat portion by interposing the supporting portion between the fixing portion and the valve seat portion.

2. The valve mechanism according to claim 1, wherein the annular fixing portion is an integrated part of a nozzle cap for discharging a fluid.

3. The valve mechanism according to claim 1, wherein the valve seat portion is integrally formed in the mouth portion of the container.

4. The valve mechanism according to claim 1, wherein the valve seat portion is fitted in the mouth portion of the container.

5. The valve mechanism according to claim 1, wherein the connecting portions has at least three connectors.

6. The valve mechanism according to claim 1, wherein the connecting portions connect the closing portion to the annular supporting portion in radial directions.

7. The valve mechanism according to claim 1, wherein the valve seat portion is replaceable and selected based on the consistence of the fluid.

8. A tube-type fluid container comprising a container body for storing a fluid having a mouth portion, and the valve mechanism of claim 1 attached to the mouth portion.

9. The valve mechanism according to claim 1, wherein the tip of the annular convex portion along the opening is in contact with a periphery of the closing portion.

10. A valve mechanism adapted for a mouth portion of a tube-type fluid container, comprising:

a valve seat portion having a single opening through which a fluid passes, said valve seat portion having an annular convex portion along the opening;

a disc-shaped valve portion comprising: (i) an annular supporting portion, (ii) a closing portion for closing the opening at the tip of the annular convex portion, said closing portion having an outer diameter smaller than an inner diameter of the annular supporting portion and larger than an inner diameter of the opening, and having a convex shape toward the opening; and (iii) multiple connecting portions connecting the closing portion to the annular supporting portion to urge the closing portion against the annular convex portion along the opening, wherein the annular supporting portion, the closing portion, and the multiple connecting portions are integrally formed; and an annular fixing portion for affixing the valve portion to the valve seat portion by interposing the supporting portion between the fixing portion and the valve seat portion, wherein the multiple connecting portions and the valve seat portion are disposed substantially parallel to each other at a distance when the closing portion is in contact with the annular convex portion along the opening.

11. The valve mechanism according to claim 10, wherein the annular convex portion along the opening is in contact with a periphery of the closing portion.

* * * * *